US012241335B1

(12) United States Patent
Luo et al.

(10) Patent No.: US 12,241,335 B1
(45) Date of Patent: Mar. 4, 2025

(54) BACKFLOW GAS HEATING AND THROTTLING DEVICE, AND SURFACE THROTTLING SYSTEM

(71) Applicant: Southwest Petroleum University, Chengdu (CN)

(72) Inventors: Jianxin Luo, Chengdu (CN); Wang Yu, Chengdu (CN); Jun Chen, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 18/787,595

(22) Filed: Jul. 29, 2024

(30) Foreign Application Priority Data

Jan. 16, 2024 (CN) ..... 202410064727.X

(51) Int. Cl.
*E21B 34/02* (2006.01)
*E21B 36/00* (2006.01)

(52) U.S. Cl.
CPC ..... *E21B 34/025* (2020.05); *E21B 36/00* (2013.01)

(58) Field of Classification Search
CPC ..... E21B 36/00; E21B 36/005; E21B 34/025; F17D 1/05; F16L 9/18; F16L 19/19
See application file for complete search history.

(56) References Cited

U.S. PATENT DOCUMENTS 2,011,100 A * 8/1935 Woods ..... F16L 53/70 138/40
2,282,675 A * 5/1942 Reginald ..... E21B 34/02 138/46
2,638,917 A * 5/1953 Clair ..... E21B 34/025 137/340
3,100,147 A * 8/1963 Raymond ..... C10G 5/06 62/611

FOREIGN PATENT DOCUMENTS

CN 104035383 A 9/2014
CN 111520103 A 8/2020
CN 113524640 A 10/2021
CN 117072088 A 11/2023

* cited by examiner

*Primary Examiner* — Robert E Fuller
(74) *Attorney, Agent, or Firm* — George D. Morgan

(57) ABSTRACT

A backflow gas heating and throttling device, and a surface throttling system, where the surface throttling system includes a Christmas tree, a backflow gas heating and throttling device, and a gas collection pipeline connected in sequence. A pipeline between the Christmas tree and the backflow gas heating and throttling device and the gas collection pipeline are both provided with a valve, a thermometer, and a pressure gauge, and the gas collection pipeline is further provided with a flow meter. The backflow gas heating and throttling device includes a gas inlet pipe, a heat pipe, a guide cone, an outer throttle pipe, an annular cover, a tapered pipe, a gas outlet pipe, a throttle plate I, a throttle plate II, and a heating rib, thereby increasing the (Continued)

natural gas temperature before throttling and further heating the natural gas during throttling to prevent hydrate generation from causing blockage.

10 Claims, 8 Drawing Sheets

BACKFLOW GAS HEATING AND THROTTLING DEVICE, AND SURFACE THROTTLING SYSTEM

CROSS-REFERENCE TO RELATED APPLICATIONS

The application claims priority to Chinese patent application No. 202410064727X, filed on Jan. 16, 2024, the entire contents of which are incorporated herein by reference.

TECHNICAL FIELD

The present invention relates to the technical field of preventing hydrate formation after throttling by a wellhead device, and in particular, to a backflow gas heating and throttling device and a surface throttling system.

BACKGROUND

In the process of developing a water-bearing natural gas well, natural gas hydrate blockage is a common problem encountered during gas field gathering, transportation, and processing. Natural gas hydrate is an ice-like compound formed by certain hydrocarbon components in natural gas and liquid water under certain temperature and pressure conditions. Local hydrate blockage will cause a reduction in the pipeline flow area. After a natural gas flow from a gas field Christmas tree passes through a gas nozzle, a throttle valve, and other throttling equipment, the temperature of the gas flow decreases and, if measures such as surface heating or antifreeze injection are not taken, may even decrease to a critical temperature for natural gas hydrate formation, thereby causing hydrate formation to block the gas pipeline. The closer to the throttling equipment, the lower the temperature, and the easier it is to cause blockage.

Existing methods to prevent hydrate formation in the prior art include down hole throttling, heating, alcohol injection, dehydration, etc. down hole throttling is to place a down hole throttle at an appropriate position in a wellbore to achieve natural gas throttling and depressurization, and a formation temperature heating method is used to allow the throttled gas flow to fully absorb geothermal heat so that the temperature of the throttled gas flow is higher than the initial temperature necessary for hydrate formation, thereby achieving the purpose of preventing hydrate formation. However, the down hole throttle has problems such as inconvenient testing and installation, easy failure of the sealant cartridge, and limitations on single well productivity.

Compared with down hole throttling, surface throttling has a different working position but a similar throttling principle. Both surface throttling and down hole throttling are achieved through a nozzle. Usually, in order to prevent hydrate formation, heating equipment such as a water jacket heater is required, or additional pipelines are injected with inhibitors to prevent freezing, which increases production costs. Multi-stage throttling is used in the prior art to prevent hydrate formation. However, this method needs to ensure that the throttling temperature drop after each throttling is not lower than the critical temperature, for which it can only increase the number of throttling stages. As a result, the throttling device is too long and requires a large placement space.

Therefore, there is an urgent need for a throttling device that can prevent hydrate formation from causing blockage, is low in cost, and has low space requirements, and a surface natural gas heating and throttling system that does not require any additional heating and inhibitor equipment lines.

SUMMARY

In view of the above problems, the present invention is intended to provide a backflow gas heating and throttling device, and a surface throttling system.

The following technical solutions are adopted by the present invention:

in one aspect, a backflow gas heating and throttling device is provided, including a gas inlet pipe, a heat pipe, a guide cone, an outer throttle pipe, an annular cover, a tapered pipe, a gas outlet pipe, a throttle plate I, a throttle plate II, and a heating rib, where the gas inlet pipe, the heat pipe, and the outer throttle pipe are arranged coaxially in sequence from the inside to the outside, with right ends of the three being flush and the length of the heat pipe smaller than that of the outer throttle pipe and the gas inlet pipe; the heat pipe and the gas inlet pipe are connected through a support column I, and a left end of the outer throttle pipe is connected to the gas inlet pipe through the annular cover; a heating annulus is formed between the gas inlet pipe and the heat pipe, a throttling annulus is formed between the heat pipe and the outer throttle pipe, and a transition zone is formed between the annular cover and a left end of the heat pipe;

the guide cone is arranged parallel to the tapered pipe, a left end of the guide cone is connected to the right end of the heat pipe, and a left end of the tapered pipe is connected to the right end of the outer throttle pipe; a constant pressure confluence zone is formed between the guide cone and the tapered pipe;

a left end of the gas outlet pipe is connected to a right end of the tapered pipe; and the throttle plate I, the throttle plate II, and the heating rib are all arranged on an outer wall of the heat pipe, the throttle plate II is arranged on a right side of the throttle plate I, and the heating rib is arranged on the right side of the throttle plate I and a right side of the throttle plate II.

Preferably, diameters of the throttle plate I and the throttle plate II are determined through the following steps:

determining a relationship between a pressure before and after throttling by the throttle plate I and the throttle plate II and a critical pressure ratio, where the critical pressure ratio is 0.55;

if a ratio of the pressure after throttling to the pressure before throttling is less than 0.55, calculating the diameters of the throttle plate I and the throttle plate II by the following formula:

$$d = \left(\frac{Q_0}{156 p_1} \times 10^3\right)^{0.476} \times (\gamma Z T)^{0.238} \tag{1}$$

where d is the diameter of the throttle plate, mm; $Q_0$ is a preset gas flow, $10^4$ $m^3/d$; $p_1$ is the pressure before throttling by the throttle plate I or the throttle plate II, MPa; $\gamma$ is a relative density of natural gas to air, dimensionless; Z is a deviation coefficient of gas before throttling by the throttle plate I or the throttle plate II, dimensionless; and T is a temperature of gas before throttling by the throttle plate I or the throttle plate II, K; and if the ratio of the pressure after throttling to the pressure before throttling is more than or equal to 0.55, calculating the diameters of the throttle plate I and the throttle plate II by the following formula:

$$d = \left(\frac{Q_0}{324} \times 10^4\right)^{0.476} \times \left(\frac{\gamma ZT}{p_2(p_1 - p_2)} \times 10^{-2}\right)^{0.238} \quad (2)$$

where $p_2$ is the pressure after throttling by the throttle plate I or the throttle plate II, MPa.

Preferably, the length of the heat pipe is greater than or equal to 1.5 m, a distance between the throttle plate I and the left end of the heat pipe is less than 0.2 m, and a distance between the throttle plate II and the left end of the heat pipe is less than 0.6 m.

Preferably, the length of the outer throttle pipe is greater than 1.25 times that of the heat pipe, the cross-sectional area of the heating annulus is less than or equal to 0.75 times that of the gas inlet pipe, the height of the guide cone is greater than or equal to 0.5 times the length of the heat pipe, and the cross-sectional area of the constant pressure confluence zone is equal to that of the gas inlet pipe.

Preferably, inner walls of both ends of the heat pipe are provided with four support columns I, and the four support columns I at the same end are evenly distributed.

Preferably, the support columns I of each set at the left and right ends are coaxially arranged.

Preferably, the right end of the outer throttle pipe and the heat pipe are also connected through a support column II.

Preferably, the number of the support columns II is four, and the four support columns II are evenly distributed.

In another aspect, a surface throttling system is further provided, including a Christmas tree, a backflow gas heating and throttling device, and a gas collection pipeline connected in sequence, where the backflow gas heating and throttling device is the one according to any one of the foregoing; and a pipeline between the Christmas tree and the backflow gas heating and throttling device is provided with a valve I, a thermometer I, and a pressure gauge I in sequence; and the gas collection pipeline is provided with a thermometer II, a pressure gauge II, a flow meter, and a valve II in sequence.

Preferably, the valve I is an emergency cut-off valve, the valve II is a ball valve, and the flow meter is an orifice flow meter.

The present invention has the following beneficial effects:

by arranging the guide cone and the heat pipe, the present invention can utilize the heat of natural gas before throttling to heat the natural gas during the throttling process, and prevent hydrate formation without providing additional heating equipment or inhibitors, which greatly reduces costs; the design of the cross-sectional area of the heating annulus compresses and heats the natural gas, which can greatly enhance the heating effect and, combined with the design of the heating rib, strengthen structural safety and further improve the heating effect so that even low-stage throttling can ensure the temperature above the critical value; and compared with high-stage throttling devices, the device of the present invention is greatly shortened in length, thereby reducing the installation space requirements of the device.

BRIEF DESCRIPTION OF THE DRAWINGS

To explain the embodiments of the present invention or the technical solutions in the prior art more clearly, the following briefly introduces the accompanying drawings required for describing the embodiments or the prior art. Apparently, the accompanying drawings in the following description show only some embodiments of the present application, and a person of ordinary skill in the art may still derive other drawings from these accompanying drawings without creative efforts.

Figure 1:
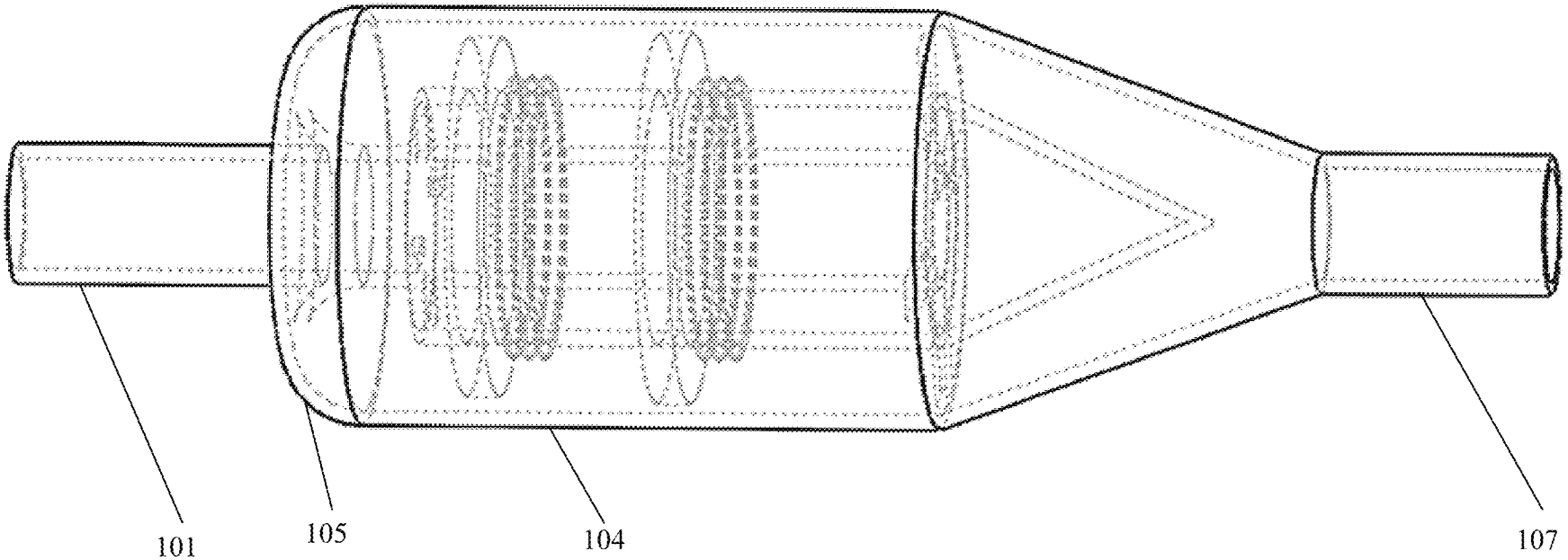
FIG. 1 is a three-dimensional structure diagram of a backflow gas heating and throttling device provided by the present invention.
Figure 2:
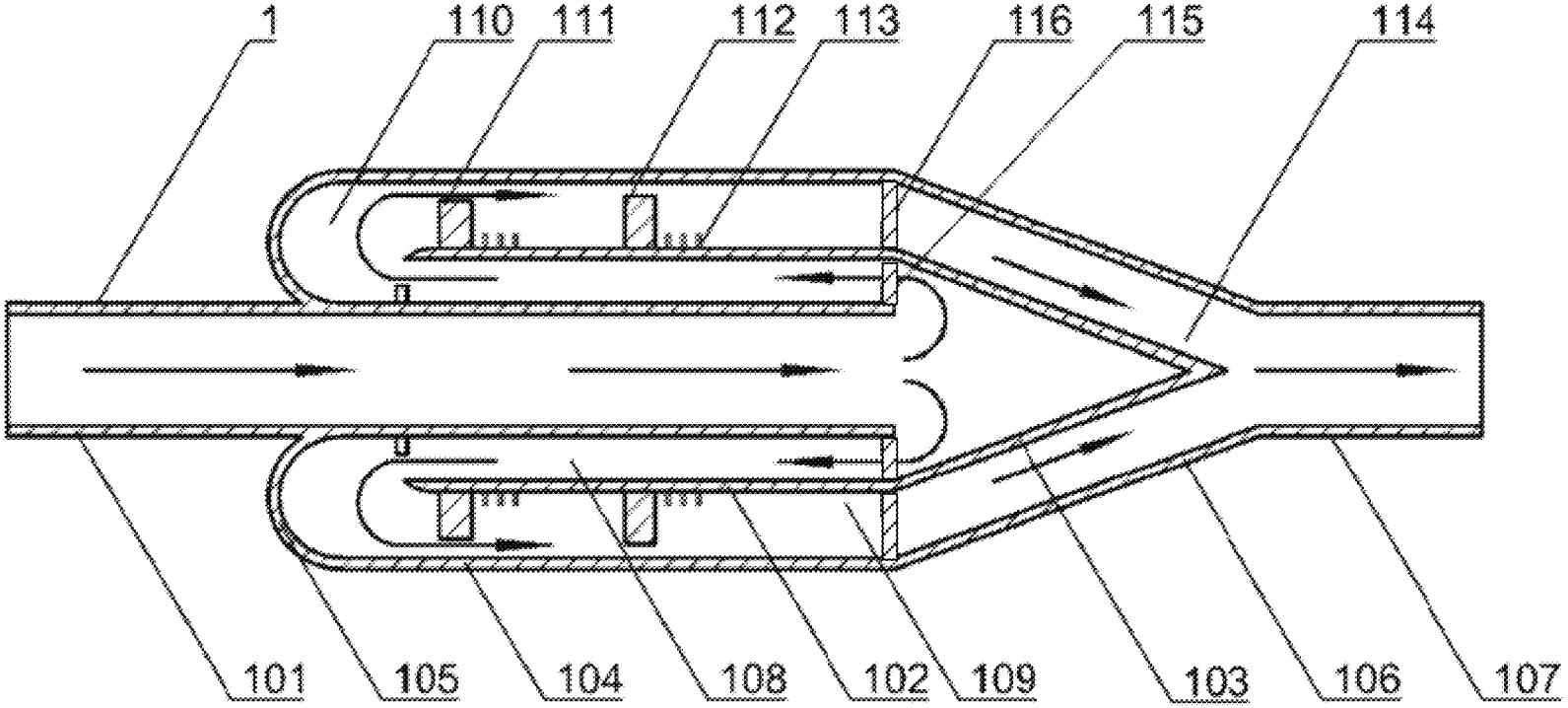
FIG. 2 is a sectional structure diagram of a backflow gas heating and throttling device provided by the present invention.
Figure 3:
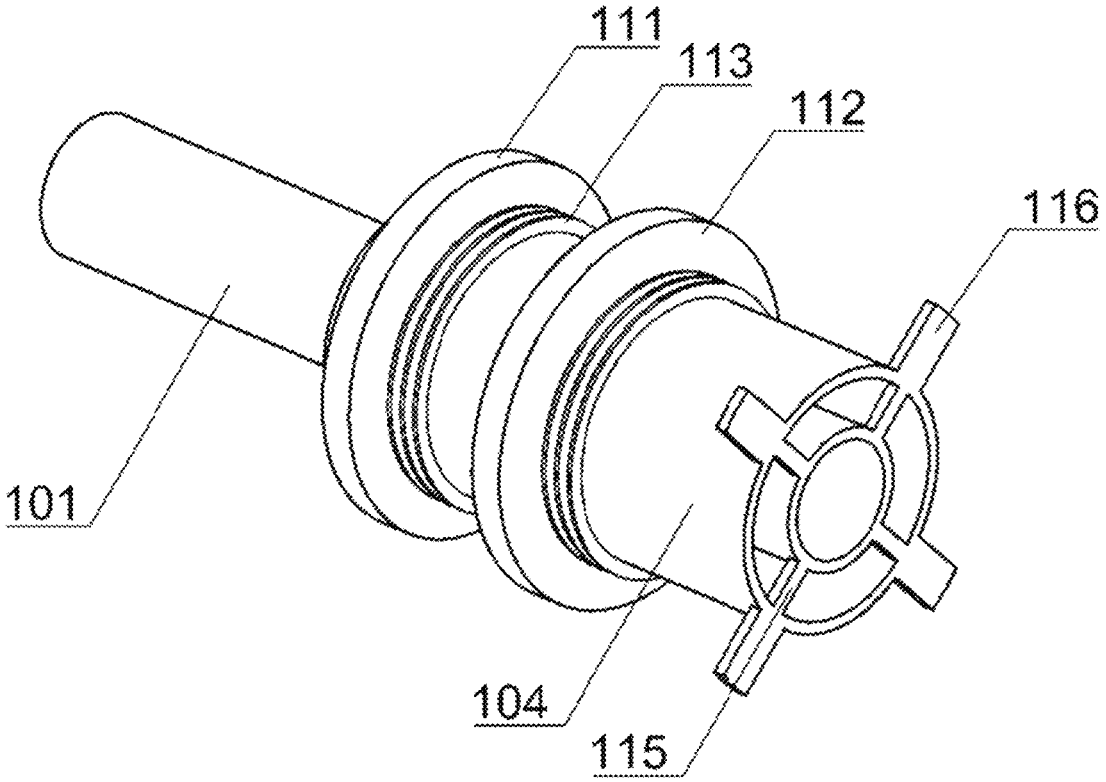
FIG. 3 is a three-dimensional structure diagram of a gas inlet pipe and a heat pipe of a backflow gas heating and throttling device provided by the present invention.
Figure 4:
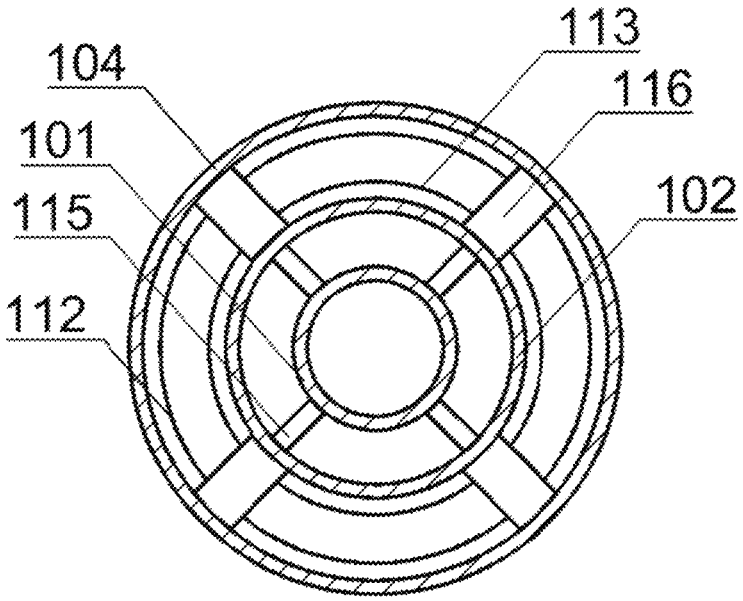
FIG. 4 is a schematic structural diagram of a right end face of a backflow gas heating and throttling device provided by the present invention.

Reference signs: 1—backflow gas heating and throttling device; 101—gas inlet pipe; 102—heat pipe; 103—guide cone; 104—outer throttle pipe; 105—annular cover; 106—tapered pipe; 107—gas outlet pipe; 108—heating annulus; 109—throttling annulus; 110—transition zone; 111—throttle plate I; 112—throttle plate II; 113—heating rib; 114—constant pressure confluence zone; 115—support column I; 116—support column II; 201—Christmas tree; 202—valve I; 203—thermometer I; 204—pressure gauge I; 205—thermometer II; 206—pressure gauge II; 207—flow meter; 208—valve II; 209—gas collection pipeline.

DETAILED DESCRIPTION OF THE EMBODIMENTS

The present invention is further described below with reference to the accompanying drawings and embodiments. It should be noted that the embodiments of the present invention and the technical features in the embodiments can be combined with each other without conflict. It should be noted that, unless otherwise stated, all technical and scientific terms used herein have the same meanings as those commonly understood by a person of ordinary skill in the art.

As used herein, unless otherwise stated, "first", "second", and the like are intended to distinguish between similar objects rather than describe a specific order or sequence. It should be understood that, as used herein, "up". "down", "left", "right", and the like generally refer to a direction shown in the accompanying drawings, or to a vertical, perpendicular, or gravitational direction of a component; similarly, for ease of understanding and description, "inner", "outer", and the like refer to the inner and outer sides relative to the outline of a component. However, the above directional terms are not used to limit the present invention. As used herein, "include", "comprise", and the like mean that an element or item appearing before the term covers an element, item, or equivalent thereof listed after the term without excluding other elements or items.

In one aspect, as shown in FIGS. 1-4, the present invention provides a backflow gas heating and throttling device 1, including a gas inlet pipe 101, a heat pipe 102, a guide cone 103, an outer throttle pipe 104, an annular cover 105, a tapered pipe 106, a gas outlet pipe 107, a throttle plate I 111, a throttle plate II 112, and a heating rib 113, where the gas inlet pipe 101, the heat pipe 102, and the outer throttle pipe 104 are arranged coaxially in sequence from the inside to the outside, with right ends of the three being flush and the length of the heat pipe 102 smaller than that of the outer throttle pipe 104 and the gas inlet pipe 101; the heat pipe 102 and the gas inlet pipe 101 are connected through a support column I 115, and a left end of the outer throttle pipe 104 is connected to the gas inlet pipe 101 through the annular cover 105; a heating annulus 108 is formed between the gas inlet pipe 101 and the heat pipe 102, a throttling annulus 109 is formed between the heat pipe 102 and the outer throttle pipe 104, and a transition zone 110 is formed between the annular cover 105 and a left end of the heat pipe 102:

the guide cone 103 is arranged parallel to the tapered pipe 106, a left end of the guide cone 103 is connected to the right end of the heat pipe 102, and a left end of the tapered pipe 106 is connected to the right end of the outer throttle pipe 104; a constant pressure confluence zone 114 is formed between the guide cone 103 and the tapered pipe 106;

a left end of the gas outlet pipe 107 is connected to a right end of the tapered pipe 106; and the throttle plate I 111, the throttle plate II 112, and the heating rib 113 are all arranged on an outer wall of the heat pipe 102, the throttle plate II 112 is arranged on a right side of the throttle plate I 111, and the heating rib 113 is arranged on the right side of the throttle plate I 111 and a right side of the throttle plate II 112.

Preferably, diameters of the throttle plate I 111 and the throttle plate II 112 are determined through the following steps:

determining a relationship between a pressure before and after throttling by the throttle plate I and the throttle plate II and a pressure threshold;

if a ratio of the pressure after throttling to the pressure before throttling is less than 0.55, calculating the diameters of the throttle plate I 111 and the throttle plate II 112 by the following formula:

$$d = \left(\frac{Q_0}{156p_1} \times 10^3\right)^{0.476} \times (\gamma ZT)^{0.238} \tag{1}$$

where d is the diameter of the throttle plate, mm; $Q_0$ is a preset gas flow, $10^4$ $m^3/d$; p is the pressure before throttling by the throttle plate I or the throttle plate II, MPa; $\gamma$ is a relative density of natural gas to air, dimensionless; Z is a deviation coefficient of gas before throttling by the throttle plate I or the throttle plate II, dimensionless; and T is a temperature of gas before throttling by the throttle plate I or the throttle plate II, K; and if the ratio of the pressure after throttling to the pressure before throttling is more than or equal to 0.55, calculating the diameters of the throttle plate I 111 and the throttle plate II 112 by the following formula:

$$d = \left(\frac{Q_0}{324} \times 10^4\right)^{0.476} \times \left(\frac{\gamma ZT}{p_2(p_1 - p_2)} \times 10^{-2}\right)^{0.238} \tag{2}$$

where $p_2$ is the pressure after throttling by the throttle plate I or the throttle plate II, MPa.

In the above embodiment, when the diameter of the throttle plate I 111 is calculated, the parameters in the formula are corresponding to those of the throttle plate I 111; when the diameter of the throttle plate II 112 is calculated, the parameters in the formula are corresponding to those of the throttle plate II 112; for ease of understanding, the pressure before throttling by the throttle plate I 111 is represented by $P_A$, the pressure after throttling by the throttle plate I 111 (that is, before throttling by the throttle plate II 112) is represented by $P_B$, and the pressure after throttling by the throttle plate II 112 is represented by $P_C$, then:

if $P_B/P_A<0.55$, the diameter of the throttle plate I is calculated by the following formula:

$$d_1 = \left(\frac{Q_0}{156p_A} \times 10^3\right)^{0.476} \times (\gamma ZT)^{0.238} \tag{3}$$

if $P_B/P_A>0.55$, the diameter of the throttle plate I is calculated by the following formula:

$$d_1 = \left(\frac{Q_0}{324} \times 10^4\right)^{0.476} \times \left(\frac{\gamma ZT}{p_B(p_A - p_B)} \times 10^{-2}\right)^{0.238} \tag{4}$$

if $P_C/P_B<0.55$, the diameter of the throttle plate II is calculated by the following formula:

$$d_2 = \left(\frac{Q_0}{156p_B} \times 10^3\right)^{0.476} \times (\gamma ZT)^{0.238} \tag{5}$$

if $P_C/P_B>0.55$, the diameter of the throttle plate II is calculated by the following formula:

$$d_2 = \left(\frac{Q_0}{324} \times 10^4\right)^{0.476} \times \left(\frac{\gamma ZT}{p_C(p_B - p_C)} \times 10^{-2}\right)^{0.238}. \tag{6}$$

In an embodiment, the length of the heat pipe 102 is greater than or equal to 1.5 m, a distance between the throttle plate I 111 and the left end of the heat pipe 102 is less than 0.2 m, and a distance between the throttle plate II 112 and the left end of the heat pipe 102 is less than 0.6 m.

In an embodiment, the length of the outer throttle pipe 104 is greater than 1.25 times that of the heat pipe 102, the cross-sectional area of the heating annulus 108 is less than or equal to 0.75 times that of the gas inlet pipe 101, the height of the guide cone 103 is greater than or equal to 0.5 times the length of the heat pipe 102, and the cross-sectional area of the constant pressure confluence zone 114 is equal to that of the gas inlet pipe 101.

In an embodiment, inner walls of both ends of the heat pipe 102 are provided with four support columns I 115, and the four support columns I 115 at the same end are evenly distributed; optionally, the support columns I 115 of each set at the left and right ends are coaxially arranged.

In an embodiment, the right end of the outer throttle pipe 104 and the heat pipe 102 are also connected through a support column II 116. Optionally, the number of the support columns II 116 is four, and the four support columns II 116 are evenly distributed. Optionally, the support columns II 116 and the support columns I 115 are coaxially arranged.

In an embodiment, an outer wall of the tapered pipe 106 is provided with an insulation layer so that heat exchange between the gas flow and the ambient environment can be ignored, and the compression process can be regarded as an adiabatic process.

Figure 5:
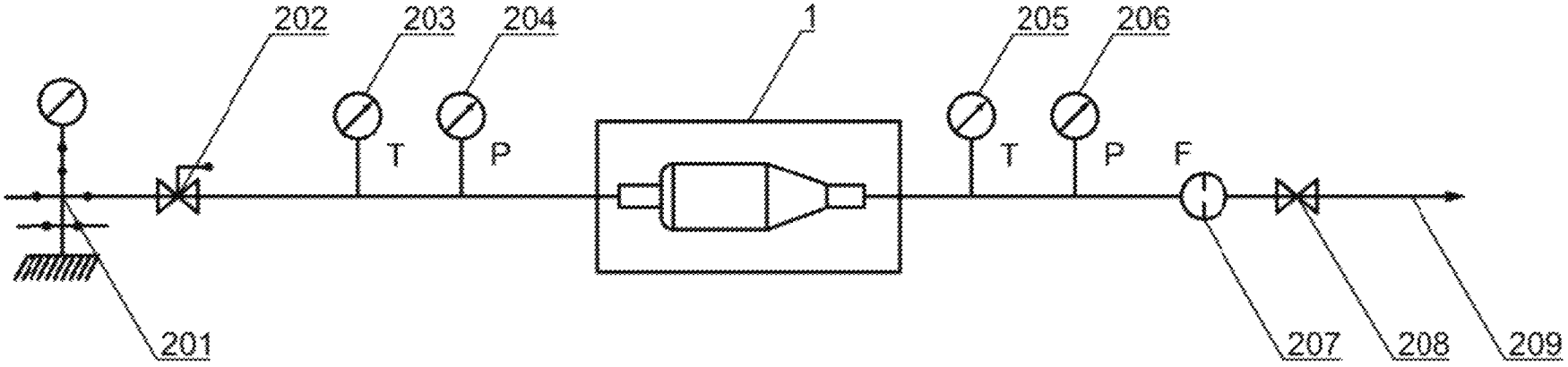
FIG. 5 is a schematic structural diagram of a surface throttling system provided by the present invention.

In another aspect, as shown in FIG. 5, the present invention further provides a surface throttling system, including a Christmas tree 201, a backflow gas heating and throttling device 1, and a gas collection pipeline 209 connected in sequence, where the backflow gas heating and throttling device 1 is the one according to any one of the foregoing; and a pipeline between the Christmas tree 201 and the backflow gas heating and throttling device 1 is provided with a valve I 202, a thermometer I 203, and a pressure gauge I 204 in sequence; and the gas collection pipeline 209 is provided with a thermometer II 205, a pressure gauge II 206, a flow meter 207, and a valve II 208 in sequence.

In an embodiment, the valve I 202 is an emergency cut-off valve, the valve II 208 is a ball valve, and the flow meter 207 is an orifice flow meter. In this embodiment, the emergency cut-off valve can cut off subsequent passages when parameters such as pressure and flow change abnormally, thereby preventing damage to subsequent equipment pipelines.

When the surface throttling system of the present invention is used, natural gas flows out from an outlet of the Christmas tree 201 and, after passing through the valve I 202, the thermometer I 203, and the pressure gauge I 204, flows into the backflow gas heating and throttling device 1 through the gas inlet pipe 101. The natural gas that meets the gas gathering pressure is obtained after throttling and depressurization by the backflow gas heating and throttling device 1 without generating natural gas hydrates in the entire process. Then, the natural gas flows out from the gas outlet pipe 107 of the backflow gas heating and throttling device 1 to the gas gathering pipeline 209.

In the backflow gas heating and throttling device 1, the natural gas entering from the gas inlet pipe 101 flows through the guide cone 103, which buffers the gas flow and changes its direction to make it flow back to the heating annulus 108 formed by the gas inlet pipe 101 and the heat pipe 102. Since the cross-sectional area of the heating annulus 108 is smaller than that of the gas inlet pipe 101, the gas flows into the transition zone 110 and then changes its direction and flows into the throttling annulus 109 formed by the outer throttle pipe 104 and the heat pipe 102. Since the cross-sectional area of the throttling annulus 109 is equal to that of the gas inlet pipe 101, after throttling and depressurization by the throttle plate I 111 and the throttle plate II 112, the gas flows out from the constant pressure confluence zone 114 between the tapered pipe 106 and the guide cone 103, and is then transported to the gas collection pipeline 209 through the gas outlet pipe 107.

During the above process, the natural gas flows back from the gas inlet pipe 101 through the guide cone 103 to the heating annulus 108. Due to the reduction of the flow area, the natural gas is compressed. The compression process is regarded as an adiabatic process without considering heat exchange between the gas flow and the ambient environment. In accordance with the principle of adiabatic compression, after passing through the heated annulus 108, the gas flow temperature and pressure will rise.

After the natural gas is compressed and heated in the heating annulus 108, the heat is convectionally transferred from the natural gas flow in the heating annulus 108 to the pipe wall through counter-current heat exchange, and then transferred through the pipe wall to the heat pipe 102 due to heat conduction. After another convective heat transfer, the heat is transferred to the throttling annulus 109 where the throttle plate I 111 and the throttle plate II 112 are located. The natural gas flow throttled by the throttle plate I 111 and the throttle plate I 112 is heated. By providing the heating rib 113, the heat transfer area of the pipe wall can be increased and the heat transfer after throttling can be enhanced. At the same time, the throttle plates are provided to further enhance the heat transfer effect. The throttle plate I 111 is arranged close to an inlet end on a left side of the throttling annulus 109 to obtain the maximum temperature rise value of counter-current heat exchange and prevent hydrate formation due to excessive temperature difference after primary throttling.

The natural gas is guided through the heating annulus 108 and the transition zone 110 into the throttling annulus 109 and, after compression, the natural gas with increased pressure is restored to the pressure in the gas inlet pipe 101 (that is, the transition zone 110 can restore the pressurized gas to the pressure when it enters the gas inlet pipe 101). After throttling and depressurization by the throttle plate I 111 and the throttle plate II 112 twice, the gas flows out from the constant pressure confluence zone 114 formed by the tapered pipe 106 and the guide cone 103. The tapered pipe 106 and the guide cone 103 are configured to have the same taper to ensure that the cross-sectional area of the tapered annulus is the same as that of an outlet of the throttling annulus 109 and equal to that of the gas inlet pipe 101 and the gas outlet pipe 107, thereby reducing pressure and flow fluctuations.

Figure 6:
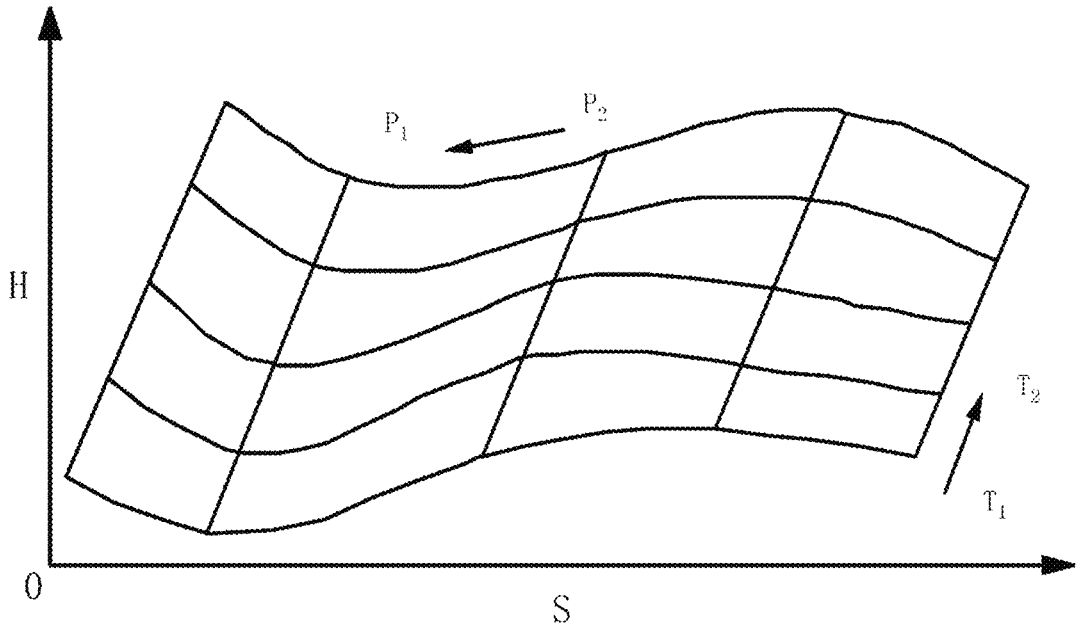
FIG. 6 is an enthalpy-entropy chart of natural gas.

In accordance with the principle of throttling expansion, the temperature, pressure, and flow of the natural gas will decrease after flowing through the throttle plates. From a predicted hydrate formation pressure-temperature curve, a critical temperature of hydrate formation after throttling can be predicted in accordance with the known pressure and relative density of the natural gas. Since the inlet pressure and temperature of the throttle plates are known, the outlet pressure after throttling can be designed by measuring the relative density. From the above values, the temperature drop after throttling by the throttle plates can be predicted through the enthalpy-entropy chart of natural gas shown in FIG. 6.

In an embodiment, a hydrate formation pressure-temperature curve is used to predict the critical temperature for hydrate formation, a graphical method is used to calculate the temperature drop after direct throttling without backflow gas heating, and then the temperature value is used to calculate the heat flow transferred in the heating annulus 108, thereby obtaining the temperature rise of the gas flow in the throttling annulus 109 after throttling, that is, the temperature after throttling by the backflow gas heating and throttling device 1.

In an embodiment, the length of the heat pipe 102 is 1.5 m, the cross-sectional area of the heating annulus 108 is equal to 0.75 times that of the gas inlet pipe 101, the throttle plate I 111 is arranged near a left end of the throttling annulus 109, with a distance of 0.1 m from the left end of the heat pipe 102, and the throttle plate II 112 is arranged in the middle of the throttling annulus 109, with a distance of 0.35 m from the left end of the heat pipe 102. The throttling results of this embodiment are shown in Table 1:

TABLE 1

Throttling Results of the Embodiment

| Embodiment | $T_0$(K) | $P_A$(MPa) | $P_B$(MPa) | $P_C$(MPa) | $T_1$(K) | $T_2$(K) | $T_3$(K) | $T_4$(K) |
|---|---|---|---|---|---|---|---|---|
| Group 1 | 303.15 | 10 | 6.5 | 2 | 301.13 | 290.20 | 292.26 | 282.69 |
| Group 2 | 303.15 | 14 | 7 | 2 | 294.84 | 291.60 | 291.77 | 282.69 |
| Group 3 | 298.15 | 10 | 6.5 | 2 | 291.42 | 290.20 | 288.31 | 282.69 |

where $P_A$ is a pressure obtained through the pressure gauge I; $P_B$ is a preset pressure after throttling by the throttle plate I; $P_C$ is a preset pressure after throttling by the throttle plate II; To is a temperature obtained through the thermometer I; $T_1$ is the lowest temperature after throttling by the throttle plate I; $T_2$ is a critical temperature for hydrate formation after throttling by the throttle plate I; $T_3$ is the lowest temperature after throttling by the throttle plate II; and $T_4$ is a critical temperature for hydrate formation after throttling by the throttle plate II; The natural gas is guided through the transition zone 110 into the heating annulus 108 and, after compression, the natural gas with increased pressure and temperature is restored to the pressure and temperature in the gas inlet pipe 101, that is, the pressure obtained through the pressure gauge I is the pressure before throttling by the throttle plate I, and the temperature obtained by the thermometer I is the temperature before throttling by the throttle plate I.

Figure 7:
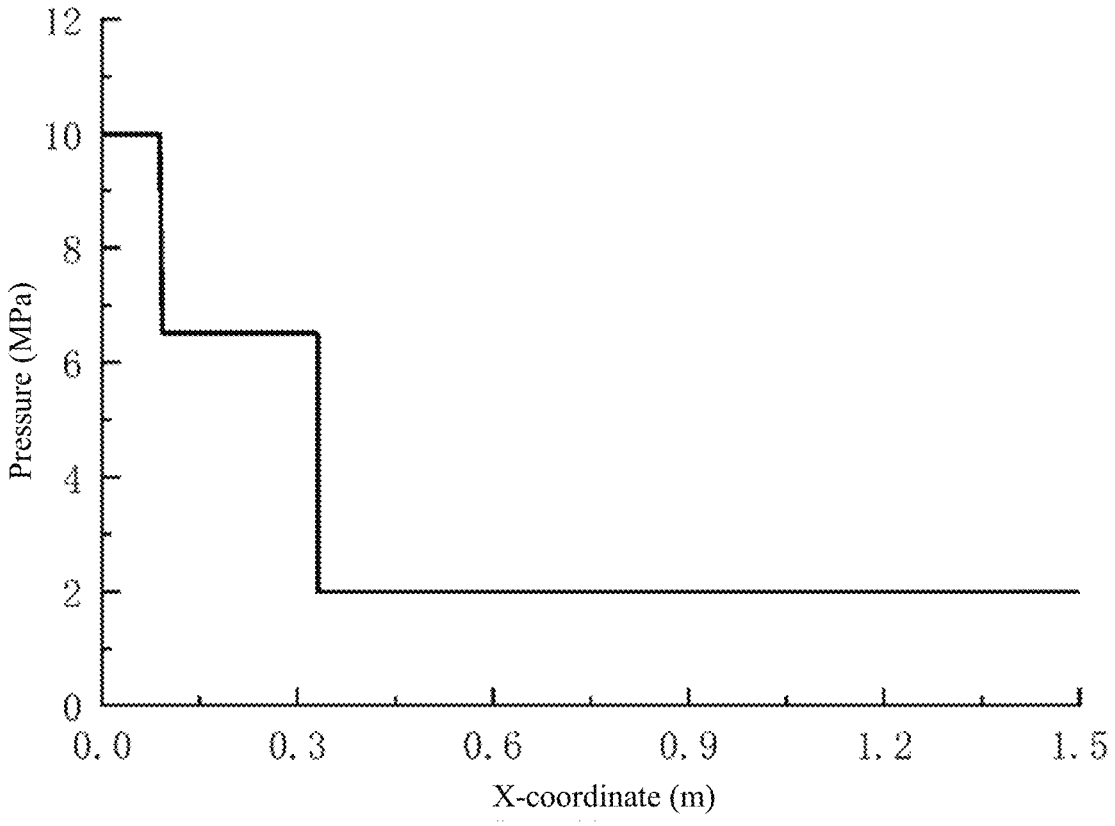
FIG. 7 is a schematic pressure change curve after throttling in an embodiment.
Figure 8:
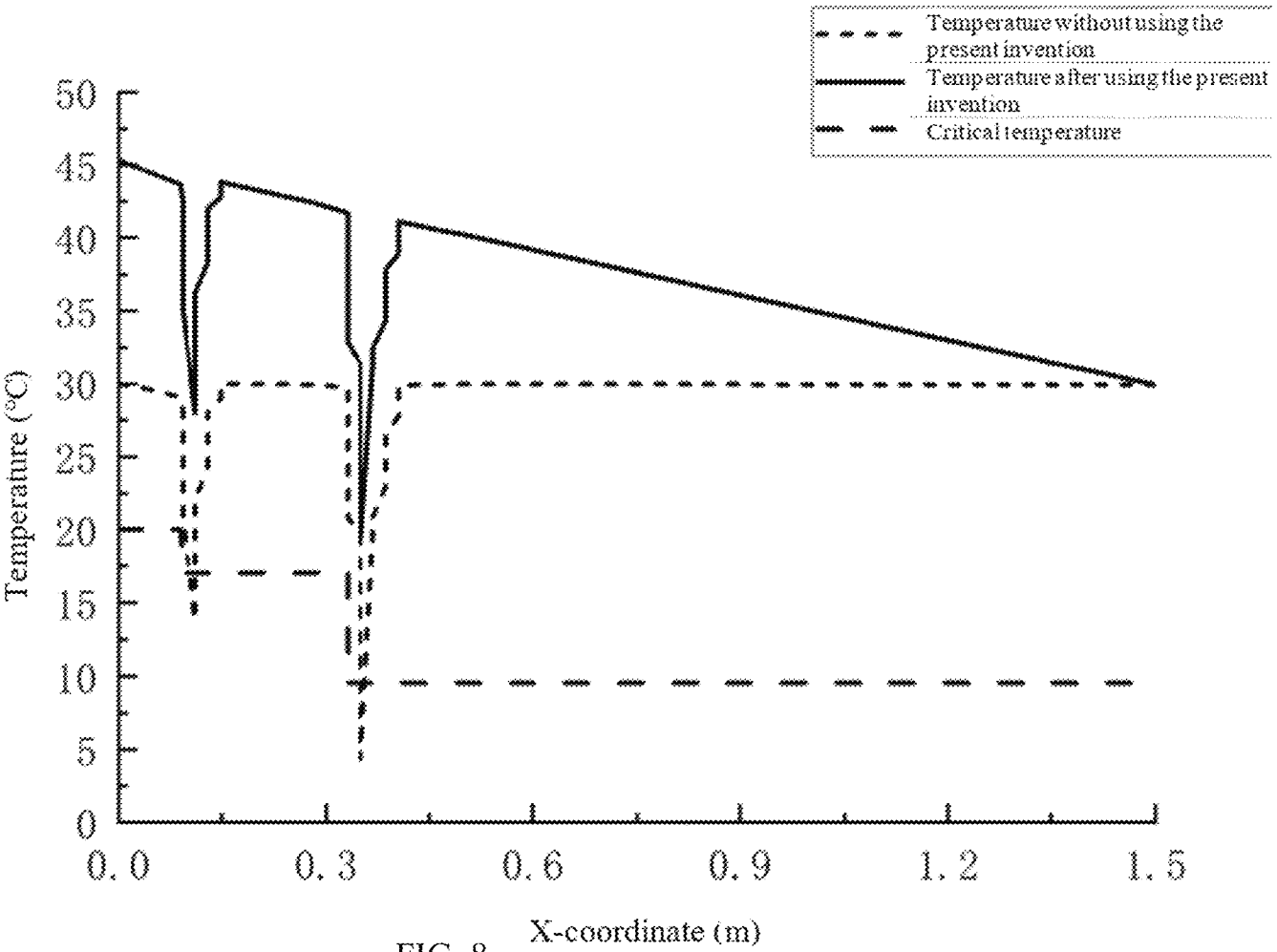
FIG. 8 is a schematic temperature change curve after throttling in an embodiment.

The pressure and temperature changes of Group 1 are shown in FIGS. 7 and 8. For Group 2, the pressure before throttling by the throttle plate I increases, $T_1$ is higher than $T_2$, and $T_3$ is higher than $T_4$ so that the throttling system can ensure that the temperature after throttling is always higher than the critical temperature for hydrate formation even under greater wellhead pressure. For Group 3, the wellhead temperature decreases and the temperature after throttling is higher than the critical temperature, thereby also ensuring that the temperature after throttling is always higher than the critical temperature for hydrate formation.

Assuming that $P_A$ is 10 MPa, $P_B$ is 6.5 MPa, $P_C$ is 2 MPa, To is 298.15 K, the cross-sectional area ratio is the ratio of the cross-sectional area of the heating annulus 108 to that of the gas inlet pipe 101, the position of the throttle plate I is represented by the distance between the throttle plate I and the left end of the heat pipe 102, the position of the throttle plate II is represented by the distance between the throttle plate II and the left end of the heat pipe 102, then the throttling results of the comparative example are shown in Table 2:

TABLE 2

Throttling Results of the Comparative Example

| Comparative Example | Length of the heat pipe (m) | Cross-sectional area ratio | Position of the throttle plate I (m) | Position of the throttle plate II (m) | $T_1$(K) | $T_2$(K) | $T_3$(K) | $T_4$(K) |
|---|---|---|---|---|---|---|---|---|
| Group 4 | 1.5 | 0.75 | 0.25 | 0.65 | 290.09 | 290.20 | 282.60 | 282.69 |
| Group 5 | 1.4 | 0.75 | 0.2 | 0.6 | 290.03 | 290.20 | 282.50 | 282.69 |
| Group 6 | 1.5 | 0.8 | 0.1 | 0.35 | 287.93 | 290.20 | 282.38 | 282.69 |

It can be seen from Table 2 that the positions of the throttle plates I and II in Group 4 both exceed the preferred position range of the present invention, $T_1$ is lower than $T_2$, and $T_3$ is lower than $T_4$, indicating that once the specified range is exceeded, hydrates will be generated after throttling. The length of the heat pipe in Group 5 is lower than the preferred range of the present invention, and the temperature after throttling is lower than the critical temperature. The cross-sectional area ratio in Group 6 exceeds the preferred range of the present invention, and the temperature after throttling is lower than the critical temperature.

It can be seen from the above analysis that if the backflow gas heating and throttling device 1 of the present invention or a backflow gas heating and throttling device with the preferred parameter setting range of the present invention is not used, the temperature after throttling is lower than the critical temperature for hydrate formation in this state, leading to hydrate formation and further blockage; after using the backflow gas heating and throttling device 1 of the present invention, the temperature rises significantly and is significantly higher than the critical temperature so that the gas flow temperature is always higher than the critical temperature for natural gas hydrate formation, effectively preventing hydrate formation from causing blockage.

To sum up, after the backflow gas heating and throttling device 1 of the present invention is used, the temperature of the natural gas after throttling by the throttle plate I 111 and the throttle plate II 112 in the throttling annulus 109 is significantly higher than the critical temperature so that the gas flow temperature is always far away from the critical temperature for natural gas hydrate formation, and no additional heating and inhibitor equipment pipelines are required. Compared with the prior art, the present invention has significant improvements.

The above-described embodiments are only exemplary embodiments of the present invention and constitute no restriction in any form on the present invention. Although the present invention has been disclosed above with exemplary embodiments, such exemplary embodiments are not intended to limit the present invention, and those skilled in the art can make some changes or modifications to equivalent embodiments with equivalent changes by reference to the technical content disclosed above without departing from the scope of the technical solutions of the present invention. However, any simple revisions, equivalent changes, and modifications made to the above embodiments in accordance with the technical essence of the present invention without departing from the content of the technical solutions of the present invention shall still fall within the scope of the technical solutions of the present invention.

What is claimed is:

1. A backflow gas heating and throttling device, comprising a gas inlet pipe, a heat pipe, a guide cone, an outer throttle pipe, an annular cover, a tapered pipe, a gas outlet pipe, a throttle plate I, a throttle plate II, and a heating rib, wherein the gas inlet pipe, the heat pipe, and the outer throttle pipe are arranged coaxially in sequence from the inside to the outside, with right ends of the three being flush and the length of the heat pipe smaller than that of the outer throttle pipe and the gas inlet pipe; the heat pipe and the gas inlet pipe are connected through a support column I, and a left end of the outer throttle pipe is connected to the gas inlet pipe through the annular cover; a heating annulus is formed between the gas inlet pipe and the heat pipe, a throttling annulus is formed between the heat pipe and the outer throttle pipe, and a transition zone is formed between the annular cover and a left end of the heat pipe;

the guide cone is arranged parallel to the tapered pipe, a left end of the guide cone is connected to the right end of the heat pipe, and a left end of the tapered pipe is connected to the right end of the outer throttle pipe; a constant pressure confluence zone is formed between the guide cone and the tapered pipe;

a left end of the gas outlet pipe is connected to a right end of the tapered pipe; and the throttle plate I, the throttle plate II, and the heating rib are all arranged on an outer wall of the heat pipe, wherein the throttle plate II is arranged on a right side of the throttle plate I, and the heating rib is arranged on a right side of the throttle plate II.

2. The backflow gas heating and throttling device of claim 1, wherein diameters of the throttle plate I and the throttle plate II are determined through the following steps:

determining a relationship between a pressure before and after throttling by the throttle plate I and the throttle plate II and a critical pressure ratio, wherein the critical pressure ratio is 0.55;

if a ratio of the pressure after throttling to the pressure before throttling is less than 0.55, calculating the diameters of the throttle plate I and the throttle plate II by the following formula:

$$d = \left(\frac{Q_0}{156 p_1} \times 10^3\right)^{0.476} \times (\gamma Z T)^{0.238} \quad (1)$$

wherein d is the diameter of the throttle plate, mm; $Q_0$ is a preset gas flow, $10^4$ $m^3/d$; $p_1$ is the pressure before throttling by the throttle plate I or the throttle plate II, MPa; $\gamma$ is a relative density of natural gas to air, dimensionless; Z is a deviation coefficient of gas before throttling by the throttle plate I or the throttle plate II, dimensionless; and T is a temperature of gas before throttling by the throttle plate I or the throttle plate II, K; and if the ratio of the pressure after throttling to the pressure before throttling is more than or equal to 0.55, calculating the diameters of the throttle plate I and the throttle plate II by the following formula:

$$d = \left(\frac{Q_0}{324} \times 10^4\right)^{0.476} \times \left(\frac{\gamma Z T}{p_2(p_1 - p_2)} \times 10^{-2}\right)^{0.238} \quad (2)$$

wherein $p_2$ is the pressure after throttling by the throttle plate I or the throttle plate II, MPa.

3. The backflow gas heating and throttling device of claim 2, wherein the length of the heat pipe is greater than or equal to 1.5 m, a distance between the throttle plate I and the left end of the heat pipe is less than 0.2 m, and a distance between the throttle plate II and the left end of the heat pipe is less than 0.6 m.

4. The backflow gas heating and throttling device of claim 3, wherein the length of the outer throttle pipe is greater than 1.25 times that of the heat pipe, the cross-sectional area of the heating annulus is less than or equal to 0.75 times that of the gas inlet pipe, the height of the guide cone is greater than or equal to 0.5 times the length of the heat pipe, and the cross-sectional area of the constant pressure confluence zone is equal to that of the gas inlet pipe.

5. The backflow gas heating and throttling device of claim 1, wherein inner walls of both ends of the heat pipe are provided with four support columns I, and the four support columns I at the same end are evenly distributed.

6. The backflow gas heating and throttling device of claim 5, wherein the support columns I of each set at the left and right ends are coaxially arranged.

7. The backflow gas heating and throttling device according to claim 1, wherein the right end of the outer throttle pipe and the heat pipe are also connected through a support column II.

8. The backflow gas heating and throttling device of claim 7, wherein the number of the support columns II is four, and the four support columns II are evenly distributed.

9. A surface throttling system having a flow direction, and comprising, connected in the following sequence along the flow direction a Christmas tree, the backflow gas heating and throttling device according to claim 1, and a gas collection pipeline; and a pipeline between the Christmas tree and the backflow gas heating and throttling device provided with a valve I, a thermometer I, and a pressure gauge I in sequence along the flow direction; and wherein the gas collection pipeline is provided with a thermometer II, a pressure gauge II, a flow meter, and a valve II in sequence along the flow direction.

10. The surface throttling system of claim 9, wherein the valve I is an emergency cut-off valve, the valve II is a ball valve, and the flow meter is an orifice flow meter.

* * * * *